United States Patent [19]

Demianczuk et al.

[11] 4,348,800

[45] Sep. 14, 1982

[54] PRODUCTION OF STEEL PRODUCTS WITH MEDIUM TO HIGH CONTENTS OF CARBON AND MANGANESE AND SUPERIOR SURFACE QUALITY

[75] Inventors: Dionisyj Demianczuk, Parma; Gregory J. McLean, Brecksville; Joseph E. Franklin, Medina, all of Ohio

[73] Assignee: Republic Steel Corporation, Cleveland, Ohio

[21] Appl. No.: 139,873

[22] Filed: Apr. 14, 1980

[51] Int. Cl.[3] ..... B22D 23/06

[52] U.S. Cl. ..... 29/527.7; 164/58.1; 164/80; 75/48

[58] Field of Search ..... 29/527.7; 164/58.1, 164/80; 75/48, 53

[56] References Cited

U.S. PATENT DOCUMENTS

| | | | |
|---|---|---|---|
| 2,389,516 | 11/1945 | Kinnear, Jr. | 22/206 |
| 3,436,209 | 4/1969 | Lojas | 75/53 |
| 3,518,079 | 6/1970 | Oswald | 75/53 |
| 3,521,695 | 7/1970 | Diener et al. | 75/48 |
| 3,590,476 | 7/1971 | Levy et al. | 29/527.7 |
| 3,837,842 | 9/1974 | Tanove et al. | 75/53 |
| 3,865,643 | 2/1975 | Bales, Jr. et al. | 148/36 |
| 4,092,179 | 5/1978 | Charpentier et al. | 148/2 |

FOREIGN PATENT DOCUMENTS

| | | | |
|---|---|---|---|
| 421424 | 12/1934 | United Kingdom | 29/527.7 |

*Primary Examiner*—Francis S. Husar
*Assistant Examiner*—V. K. Rising
*Attorney, Agent, or Firm*—Cooper, Dunham, Clark, Griffin & Moran

[57] ABSTRACT

Steel products having high strength or good drawing or magnetic or electrical properties, requiring levels of carbon or manganese, or both, that are too high to allow rimming action are produced to have the desired properties, in effect, but with a surface condition characteristic of rimmed steel. The method involves pouring an ingot mold 80 to 95% full of molten, rimming steel, then allowing the steel to stand and rim for several minutes while a shell freezes against the mold wall, and thereafter filling the mold while inserting into the molten steel stream additional carbon or manganese, plus any other elements such as P, Al, Cb, V, Cr, Ni, Si or others, so that the core of the ultimately solidified ingot is steel having the above-desired strength or other properties. An integral shell or skin of rimmed steel, essentially all ferrite, covers the principal surface of the ingot, and likewise of slab, plate, and hot rolled and cold rolled strip or the like that may be derived from the ingot, thereby affording products which are in effect of the desired internal composition but have the superior surface condition of rimmed steel.

9 Claims, No Drawings

PRODUCTION OF STEEL PRODUCTS WITH MEDIUM TO HIGH CONTENTS OF CARBON AND MANGANESE AND SUPERIOR SURFACE QUALITY

BACKGROUND OF THE INVENTION

This invention relates to novel and efficient methods of producing steels and steel products having relatively high carbon or manganese content, or both, with good surface quality, being particularly the surface characteristics of rimmed steel, and to certain steel products so made. More particularly, the invention is concerned with the manufacture of steels and steel products with which to achieve desirable properties in the area of strength, toughness, ductility, magnetic characteristics or the like, where the required proportion of manganese or carbon, or both elements, is significantly higher than would normally be contemplated in order to permit good rimming action in the melt of steel employed.

A chief reason for wanting a steel product which is of properly rimmed character is that such products have excellent surface quality, as well as certain ancillary benefits usually associated with the surface regions of rimmed steels. As indicated, however, there are definite limits to the content of carbon or manganese (or both) that can be employed without adversely affecting the rimming action and without likewise impairing the good surface quality achieved by such action. Thus, for example, higher carbon steels, as up in the range of 0.2 and greater percent, are particularly suitable for many structural purposes, as sheets or bars in hot rolled as well as cold rolled state. Yet such products cannot be made satisfactorily as rimmed steel because of the high carbon content. Hence, it has been impossible to obtain in a convenient, economical manner, the good surface condition of a rimmed product, at the indicated carbon levels, Likewise with or without the higher range of carbon, the manganese content of rimmed steels has necessarily been limited. Although compositions containing manganese above, and indeed well above 0.6%, are particularly suitable for commercial stamping and drawing grades (e.g. cold rolled products), such grades cannot be made as rimmed steels, or more particularly, cannot achieve the highly desirable surface characteristics of rimmed steel.

The prior art contains disclosures of methods wherein a melt of rimming steel, e.g. basically suitable for deep drawing purposes when cold rolled, has been poured to nearly fill an ingot mold, whereupon teeming has been interrupted for several minutes to permit rimming action while a skin of rimmed steel solidifies against the mold wall, and then teeming is continued to fill the mold with aluminum introduced into the falling stream of molten steel so that the ultimate ingot consists of a core of aluminum killed steel having a skin of rimmed steel. From such ingot, rolled products are described as made having basically the properties (in the core) of killed steel, with a rimmed surface; some suggestion has been made to add other elements, such as columbium, in very limited quantity for special purpose along with the aluminum, but there was essentially no thought of producing anything beyond the aluminum-killed, deep drawing product having a surface zone of rimmed steel.

Some more recent inventions, covered by pending patent applications, have embraced products having rimmed steel surface layers over cores that may not only be aluminum killed, but contain other special ingredients such as microalloying elements (e.g. Cb, V, Ti) providing a high strength, low alloy core of very low carbon content, or elements such as phosphorus for particular purposes; or alternatively rimming steel compositions, similarly providing a rimmed skin, with a rimmed core having a content of vanadium or boron such that the aging normally characteristic of rimmed steels is successfully retarded, without producing the difficulties that ordinarily accompany the use of the last-mentioned elements to make a rimmed steel non-aging.

None of the above disclosures, however, has been directed to steels, especially of structural grades, that basically require substantially higher levels of carbon or manganese, or both, and that therefore cannot ordinarily be produced as rimmed steel. In U.S. Pat. No. 2,389,516, Kinnear, Nov. 20, 1945, there is proposed a process where an ingot mold, e.g. of 19 to 20 tons capacity, is first poured to a level of about 65% with rimming steel such as 0.08% C and 0.38% Mn content, which is then allowed to rim or effervesce in its normal manner for about 15 minutes. Thereupon molten, killed or deoxidized steel, i.e. containing 0.78% C, 0.8% Mn and 0.26% Si, is added to the ingot mold on top of the first-introduced, rimming steel (of which the core is still molten), with the result that the additional steel diffuses into the central portion or core of the rimming steel, stopping the rimming action by the time the mold is entirely filled.

The solidified result of the above patent, in the lower 65% of the mold, from which the upper 35% is cropped after rolling to slab, is described as a steel body consisting of a low-carbon skin and high-carbon core having higher strength and elasticity than the skin. This process, however, is relatively inefficient or impractical, not only because such a relatively large amount of the ingot is wasted but especially because two separate melts of steel must be prepared, and separately carried in ladles for the two pouring operations in each of the molds of a single drag. Aside from problems of making and timing the melts, the operation is cumbersome, and indeed beyond the capability of conventional melt shops, i.e. as to the requirement of providing and using, almost simultaneously, two separate cranes and two separate ladles. Hence, even as to steel of high carbon content, there has been no economical or truly feasible way of making a product with the clean qualities, at or near the surface, of rimming grades.

SUMMARY OF THE INVENTION

The invention provides a new and effective method of producing steel products having superior properties of strength, toughness and the like as economically achieved by a relatively high content of carbon or manganese, or both (such being a higher proportion of one or both elements than is consonant with naturally good rimming action), while providing on the principal surface of the product an integral skin of rimmed steel having the superior surface quality of such rimmed steel. The method essentially consists in first making a base melt of rimming steel, e.g. containing up to 0.12% carbon and up to 0.6% manganese, with no deoxidizing elements sufficient to interfere significantly with rimming. This melt is teemed into each ingot mold, to the point of 80% to 95% full, whereupon pouring is interrupted while effervescent rimming action proceeds and a skin or shell of steel solidifies next to the mold wall. After a waiting period of 2 to 8 minutes, even up to 15 minutes although 5 or 6 minutes usually suffices, teeming of the same base melt into the mold is resumed while injecting into the stream of metal sufficient amounts of carbon or manganese, or both, for instance as one-fourth inch size particles of pure carbon or graphite or manganese or ferromanganese, to provide a desired content of C or Mn in the ingot core.

As a result, the ultimately solidified ingot constitutes a core of the desired steel surrounded by a skin of steel which is essentially pure ferrite, i.e. low-carbon, low-manganese steel in rimmed state, having a clear surface of superior quality.

If desired, the core body may be aluminum killed, i.e. by adding sufficient aluminum, for instance up to 0.2% during the interval of back-filling, which means the interval of the completion of teeming into the ingot mold; aluminum can be added in even larger amounts, for other known purposes. Other elements may be added at the same time, as by injection of solid pieces of the element or a conventionally alloyed form of it, such as a ferro-alloy, into the falling stream of molten steel. Other elements that can be so introduced include silicon, as for certain strengthening function and also deoxidation; phosphorus for known strengthening effect; limited amounts of substances usually considered microalloying as in high strength, low alloy steel. The latter elements can be columbium, vanadium, titanium or zirconium. If the body of the steel is insufficiently deoxidized to be fully killed and thus, although not of rimming character, may be found to exhibit some aging, addition of vanadium may obviate this problem, or alternatively, boron. Still other additions that can be made during the back-filling include copper, chromium, nickel, sulfur and molybdenum, in minor but significant quantities and for conventional purposes.

The described procedure is highly effective and yields a product which has the strength, toughness and hardness properties of the higher carbon and manganese contents in steel. At the same time, the method affords production of such a steel, represented by the core metal, which nevertheless has in effect a surface or skin of superior quality, being a satisfactory rimmed grade that is essentially pure ferrite.

The invention also affords new steel products of the nature described, especially steel products having a body, i.e. as core, that contains manganese in the range above 0.6%, i.e. up to 1.75%, with consequent strength advantages of a relatively high manganese steel. This product, which is in fact new, is further characterized by the skin, over its principal surface area, of rimmed steel which is essentially ferrite. As will be understood, the carbon content of such steel, i.e. in the core, may be of any desired level, as even up to 0.9%. This high manganese product, with superior surface quality, is particularly useful where there is need for a steel of good tensile strength that has superior toughness and impact strength.

DETAILED DESCRIPTION

The base melt of rimming steel is prepared by any suitable, conventional process, as in a furnace of the so-called basic oxygen type, i.e. utilizing a process of such nature, to produce steel having a composition consisting of 0.01 to 0.12% carbon, 0.1 to 0.6% manganese, 0.15 max. % phosphorus, 0.2 max. % sulfur, balance iron and incidental elements. In some cases, it may be desired to include 0 to 2.0% copper in the base melt, as by requirement of users who want the advantage of this element in contributing corrosion resistance at the surface of the ultimate product, but present preference is to omit copper from the base melt, and to use it, if at all, only in the core steel as explained below, because copper is notorious for causing problems in the surface of an ingot and articles rolled from it. Primarily, the base melt is a low-carbon, low-manganese steel, for example with 0.03 to 0.12% C and 0.2 to 0.6% Mn, capable of vigorous rimming action and of solidifying to a metal which is essentially ferrite.

So prepared, the base melt is teemed from the usual ladle into ingot molds. In each instance, the molten steel is first poured until the mold is 80 to 95% full, e.g. 85 to 90%, and pouring in that mold is interrupted for a time of 1 to 15 minutes, usually 4 to 6 minutes while rimming action, involving the usual effervescence, proceeds and while a skin or shell of steel solidifies against the mold wall, for instance to a thickness of ½ to 4 inches. Thereupon, teeming is continued from the ladle of molten steel until the mold is full, and during such back-filling the desired additional element or elements are added to the molten core in the mold, conveniently by injection into the falling stream of metal, as explained below. As will be understood, after the partial filling of the first mold, the ladle may be advanced to one or more succeeding molds, for the same partial filling of 80 to 95%, and then returned for the described back-filling of the earlier mold or molds while the later mold or molds are waiting; the method can thus be managed, for each 2 or 3 molds, to save time and to help keep the ladle metal molten at high temperature.

The invention is chiefly concerned with producing steel having the internal composition and properties of steel with medium or high content of material of the class consisting of carbon and manganese, the process nevertheless having the advantages usually found in making rimming or semi-killed steel, i.e. better yield (reduced core loss) and shorter (track) time between pouring and soaking, as well as the superior surface that is characteristic of rimmed steel, such improved surface being exhibited after hot rolling and also after cold rolling. Hence, the invention affords an unusually economical way of preparing steel, especially rolled steel products, having the mechanical or other properties achieved by the above higher contents of manganese or carbon, or both, and having a rimmed steel surface. Such surface characteristics include not only a clean surface, more suitable for various coating or other treatments, relatively free of inclusion or like contamination, requiring less scarfing or other conditioning, and having less imperfections conducive to formation of cracks or the like, and also a surface which can be classed as relatively soft, in causing less wear of hot mill or other rolls than occurs when rolling relatively harder steels having the higher carbon or higher manganese contents of the core steel in the present invention.

Particularly suitable and economical base steel compositions for the present invention, presently preferred as appropriate for rimming action, have been found to be those containing 0.05 to 0.08% C and 0.2 to 0.5% Mn, within a broader but here useful, rimming-steel range of 0.03 (or even 0.01) to 0.12% C and 0.2 (or 0.1) to 0.6% Mn; further content, in all cases, being 0.045 max. % P and 0.20 max. % S. As explained above, molten steel of a rimming composition within these ranges is teemed into the ingot mold to a level of 80 to 95% full, and then after the described several minutes of waiting, teeming is resumed while additional material is injected into the falling stream of molten steel, preferably as solid particles of approximately ¼ inch size or less. The injected solids primarily comprise manganese or carbon, or both, which are found to diffuse very uniformly and satisfactorily into the molten core of the ingot being cast, so that the core of the solidified ingot, which effectively characterizes the ingot and products made from it as to essential mechanical properties (tensile and yield strength, toughness, ductility) or metallurgical, magnetic or other properties, is a steel with carbon above 0.12% (to 0.9%) or manganese above 0.6% (to 1.75%), or both, i.e. as if so constituted in the original, as-poured molten steel.

The material added to the molten core in the mold, as by adding same in particulate solid form to the back-filling stream, may or may not include other elements along with manganese or carbon. For instance, deoxidizing elements of the nature of aluminum and silicon, can be added, such as sufficient aluminum to equal 0.02 to 0.2% Al to achieve an aluminum-killed core. Al can be used in greater amounts, up to 0.5% in the ingot core, as for aluminized electrical steel, i.e. used in magnetic cores of electrical equipment. Elements such as chromium, nickel, molybdenum and silicon can be added for their known, conventional, alloying functions in steels of the selected Mn and C content, e.g. so that the ingot core may contain from zero to 2.0% Cr, to 3.5% Ni, to 1.0% Mo and to 3.5% Si. Copper can be added, 0 to 2.0%, either in part or all in the base (rimming) melt and if desired in part along with the back-fill, but very preferably if it is desired, only in the back-fill; thus in process or product, copper content can be defined as 0 to 2% in each of the base melt and core, embracing either mode of inclusion. Additional sulfur may be added, e.g. as in combined form during back-filling, to a core content up to 0.5% for desired purpose, and likewise phosphorus, e.g. as ferrophosphorus, for known strenghtening or other function (for instance, in electrical steels) up to 0.20% in the ingot core. Special strengthening purposes (tensile or toughness) may be enhanced by small amounts of columbium or vanadium, or both, in the core, e.g. 0 to 0.75% of each, exemplified by 0.02 to 0.10% Cb and 0.05 to 0.20% V, as used in so-called high strength low alloy steels. Similar additions of titanium and zirconium, for like effects, are possible, e.g. to 0.75% of each in the ingot core. if the core steel is likely (when not killed) to exhibit an unwanted tendency to aging, such may be countered by the inclusion of vanadium (as above) or of boron (0 to 0.075%).

Very preferably, the material to be added to the molten steel in the ingot mold, e.g. while back-filling and at the locality where the molten stream enters the core mass, is injected as small, solid particles into the falling stream. Thus, manganese can be in the form of pure (electrolytic) manganese, massive manganese or ferromanganese, while carbon may be added as pure carbon or graphite, or an alloy of C-Mn or Fe-C or other suitable alloy. The other elements, when used, may be in elemental form if feasible or in suitable alloyed or combined form, such as ferro-alloys. The actual addition may comprise a mixture of separate, particulate components, or of a few multi-element alloys, or conceivably may be a single, solidified alloy of all selected elements. However or in whatever form inserted (even in other physical state, or as rod of compacted powders), the addition is advantageously started with back-filling and completed before pouring is terminated. As will be understood, suitable techniques and devices are known for feeding particles, granules or other pieces of solid metals or alloys into a falling stream of molten steel, e.g. which is being teemed from a ladle; the chief purpose here is to get the material injected not later than the end of teeming.

When the ingot mold is finally filled, with the added material, the ingot is allowed to solidify and is treated in accordance with ordinary steel practice, having regard as necessary to the nature of the core metal, e.g. whether partially or wholly killed, or semi-killed. If desired, suitable technique may be employed to retard solidification of the molten steel remaining in the mold at the end, for instance by applying a topping compound or by employing a so-called hot top; in the latter event, the first or partial filling should be interrupted at or below the lower boundary of such structure.

Ingots so produced are handled in conventional manner, being hot rolled to bloom and then to slab; the end portion of the slab corresponding to the uppermost 5 to 20% (usually 5 to 15%) of the ingot being preferably cropped. The slab can be hot rolled to plate, strip or other shape, as under conditions known to be suitable for the steel of the ingot core. If desired, the hot rolled product, after suitable cooling and treatment, may be of a composition appropriate for cold rolling, and such operation can be used, with suitable annealing and temper rolling, to produce cold rolled strip having its principal surface, being both wide faces (as also in the hot rolled product) covered by a skin of rimmed steel, being essentially ferrite that has the composition of the original base melt. Except for its superior surface, and better economy and convenience of production and hot rolling, the ultimate products such as plate and strip (or sheet) have the properties and uses that characterize the core composition, e.g. as to tensile and yield strength, impact strength and toughness, ductility, elongation, or magnetic or electrical properties, all especially in conjunction with the higher ranges of carbon or manganese content.

At the same time, the core of each product is covered at its principal surface (e.g. both faces) with an integral skin of what is essentially pure ferrite, i.e. rimmed steel. This skin, i.e. in hot rolled strip up to 0.5 inch thick, may be 0.001 to 0.010 inch (preferably 0.003 inch or more) thick, or one-half to one-third such thickness in cold rolled strip.

A number of experimental tests of the invention have been made, producing ingots of commercial size, and deriving strip products which exhibited the desired properties and characteristics. In one such example, two ingots, each 38,000 lbs., were produced in 56 inch by 92 inch high open top molds. The base melt was rimming steel, with composition 0.05 max. % C, 0.3 to 0.4% Mn, $<$0.04% P, 0.02 max. % S. In each case, the ingot mold was first poured about 85 to 90% full; then after 5 to 6 minutes of rimming time, the molds were each injected (i.e. in the back-filling stream for each mold) with a mixture of 171 lbs. of electrolytic manganese, and ferrophosphorus containing 48 lbs. of phosphorus. The resulting ingots, i.e. in the core of each, contained sufficient Mn, 0.70 to 0.90%, and P, 0.11 to 0.15%, to develop certain desired magnetic characteristics in the finished product, for use as motor lamination stock.

Each ingot was treated as semi-killed steel and was hot rolled to slab of cross-section $42\frac{1}{2} \times 7\frac{3}{4}$ inches, thereafter to hot rolled strip, and ultimately to cold rolled (and annealed) sheet (strip), 40¼ inches wide by 0.022 to 0.024 inch thick. The slab from one ingot, sampled for analysis, showed Mn content in the core, specifically at various places from the ingot top center to near the edge in the bottom region, of 0.84, 0.82, 0.74 and 0.80%, with P content at the same places of 0.156, 0.068, 0.084 and 0.064%. The cold rolled strip had the above desired properties, and was covered on its opposite wide faces by a thin, integral, surface zone of rimmed quality. It was observed that in production of these ingots of the present steel there was improvement as to core loss, by 16%, in comparison with a composition like the base melt (Mn to 0.4%) but having 0.11 to 0.15% P.

As another example, a 38,000 lb. ingot was cast by the process described hereinabove, using a base composition of rimming steel containing 0.06% C, 0.34% Mn, 0.010% P and 0.028% S. After teeming the ingot mold to about 90% full with this steel, pouring was interrupted for about 5 to 6 minutes while rimming action occurred and a shell of rimmed steel froze next to the mold wall. Then filling was completed while adding 30 lbs. of carbon (as particles of pure carbon) into the teeming stream. The solidified ingot was treated as semi-killed steel, and was hot rolled into slab, which was sampled and analyzed. From the upper part of the ingot, whereas the rim or edge regions showed the expected low carbon content, the core exhibited (at different places) carbon contents of 0.25, 0.32 and 0.38% respectively.

A further example of experimental test involved making a 38,000 lb. ingot, using metal of a base heat containing 0.055% C, 0.45% Mn, 0.145% P and 0.017% S. The ingot mold for this test was poured 85 to 90% full, and then allowed to rest for 4½ minutes while rimming action progressed. Thereupon, filling was completed, while electrolytic manganese (amount, 165 lbs.) was injected into the teemed stream of molten steel. The completed ingot was treated as semi-killed steel, being hot rolled first to slab and then to strip. Thereafter, the strip was cold rolled and the cold rolled strip was duly annealed. The body or core of the slab was sampled, and showed manganese contents, toward the top and bottom of the ingot respectively, of 0.84% and 0.87% Mn.

The cold rolled and annealed coil was also sampled, and analyzed for manganese and phosphorus, at various places of the body or core (not the rimmed skin region); at a region from the top of the ingot, there was 0.88% Mn and 0.136% P at the center of the strip and 0.78% Mn and 0.136% P toward the edge. At a region from the bottom of the ingot, the strip center had 0.76% Mn and 0.116% P, and the edge region had 0.76% Mn and 0.098% P. Thus, the produced steel had the desired high proportion of manganese, while carrying and integral surface skin of rimmed steel. It was observed that there was a significant improvement, with respect to core loss, as compared with lower managanese steel.

It will now be apparant that the invention has considerable utility, especially in making steels having a variety of uses that require carbon or manganese at higher levels and that are improved by a surface zone of rimmed steel. Thus, the process is notably effective in producing commercial stamping and drawing grades (with high carbon, as 0.14 to 0.3%); an example is in plate or sheet to make hemispherical domes for high pressure tank heads, a typical composition (core) being 0.20% C, 0.3 to 0.5% Mn. In such case, the rimmed skin is highly desirable, and the steel affords unusually good draw performance. Another example of such use for a high carbon composition with good surface quality, is in making spiders for car wheels, a typical requirement being 0.14 to 0.18% C, 0.3 to 0.5% Mn.

Another specific use for products prepared in accordance with this invention is for electrical steels (e.g. magnetic core laminations) as indicated above; one typical kind, often cold rolled and annealed, has the composition 0.05 max. % C, 0.09 to 0.14% P, 0.70 to 1.00% Mn.

A further steel product, produced in accordance with the invention and having the advantageous, integral, surface zone of rimmed character, is made with compositions having both carbon near and up to 0.30 or more %, and manganese near and up to 0.90%. Thus, for truck or trailer undercarriage structure, a suitable range is 0.12 to 0.30% C, 0.5 to 0.9% Mn, within which one preferred composition is 0.17 to 0.19% C and 0.6 to 0.9% Mn; a typical alternative, for high strength requirements, is 0.14% C, 0.80% Mn and 0.02% Cb. In making the last-mentioned steel, a rimming melt (low-C, low-Mn) is first poured to 85 to 95%, and then after several minutes of rimming time, and shell solidification, further C and Mn, and the required Cb are added while pouring is finished, to provide the desired core composition.

It is to be understood that the invention is not limited to the specific examples of method and composition herein described, but may be carried out in other ways without departure from its scope.

We claim:

1. A method of making a high-strength steel product, comprising pouring an ingot mold 80% to 95% full of molten steel consisting essentially of 0.01 to 0.12% C, 0.1 to 0.6% Mn, 0 to 2.0% Cu, 0.15 max. % P, and 0.20 max. % S, balance iron and incidental elements, allowing said filling to undergo rimming action while a shell of rimmed steel solidifies next to the mold surrounding a still-molten core, and then completing pouring of said molten steel into said ingot mold while adding to the molten steel in the mold sufficient carbon so that the core of the ultimate, filled ingot contains carbon in the range above 0.12%, to 0.9%, said addition to the molten steel in the mold during said completion of pouring also including adding material to provide a total core content of 0 to 0.20% P, 0 to 0.5% S, 0 to 3.5% Si, 0 to 0.5% Al, 0 to 0.75% of each of one or more of the elements Cb, V, Ti and Zr, 0 to 0.075% B, 0 to 2.0% Cu, 0 to 2.0% Cr, 0 to 3.5% Ni and 0 to 1.0% Mo; and after solidification of the said ferrite-shell-carrying ingot, converting, by rolling, that part of the solid ingot which was poured first and which constitutes at least about the lower 80% of the solid ingot, to a rolled product having a skin of rimmed steel which is essentially ferrite over the principal surface area of the product, and beneath said skin a core containing carbon in greater proportion than 0.12%, said addition of carbon during said completion of pouring of the first-defined molten steel being effected by injecting solid material containing carbon so that such carbon enters the molten steel in the mold while the stream of molten steel, which completes the pouring, falls into the steel in the mold.

2. A method as defined in claim 1, in which said addition of carbon during said completion of pouring is effected, by directing pieces of solid material containing carbon, into the stream of molten steel falling into the ingot mold during said completion of pouring.

3. A method as defined in claim 1, in which the first-described pouring of steel is to at least about 85% filling of the mold and in which after said first-described pouring the partial filling is allowed to stand, undergoing said rimming action and solidifying said shell, for a time of about two to six minutes.

4. A method as defined in claim 1, in which the first-mentioned molten steel contains 0.03 to 0.12% C and 0.2 to 0.6% Mn.

5. A method as defined in claim 1, in which the first-mentioned molten steel contains 0.03 to 0.12% C, 0.2 to 0.6% Mn and no copper.

6. A method as defined in claim 1, in which the addition of all material as aforesaid to the molten steel in the mold during completion of pouring is effected by injecting solid pieces containing said last-mentioned material so that such material enters the molten steel in the mold along with the stream of molten steel falling into the mold during said completion of pouring.

7. A method as defined in claim 6, in which said addition to the molten steel during completion of pouring comprises aluminum for adding 0.02 to 0.2% Al to constitute the core of the solidifed ingot as aluminum-killed steel.

8. A method as defined in claim 6, in which the first-described pouring of steel is to at least about 85% filling of the mold and in which after said first-described pouring the partial filling is allowed to stand, undergoing said rimming action and solidifying said shell, for a time of about two to six minutes.

9. A method as defined in claim 8, in which the addition of material to the molten steel in the mold during completion of pouring is effected by directing solid pieces containing said last-mentioned material into the stream of molten steel falling into the ingot mold during said pouring.

* * * * *